US008122592B2

(12) United States Patent
Giacomin

(10) Patent No.: US 8,122,592 B2
(45) Date of Patent: Feb. 28, 2012

(54) METHOD FOR PRODUCING A LOW-CURRENT SWITCH MODULE COMPRISING ELECTRICAL COMPONENTS

(75) Inventor: Fabrice Giacomin, Creteil Cedex (FR)

(73) Assignee: Valeo Securite Habitacle, Créteil Cedex (FR)

( * ) Notice: Subject to any disclaimer, the term of this patent is extended or adjusted under 35 U.S.C. 154(b) by 466 days.

(21) Appl. No.: 12/446,557

(22) PCT Filed: Oct. 18, 2007

(86) PCT No.: PCT/EP2007/061176

§ 371 (c)(1),
(2), (4) Date: Apr. 21, 2009

(87) PCT Pub. No.: WO2008/052891

PCT Pub. Date: May 8, 2008

(65) Prior Publication Data

US 2010/0214045 A1 Aug. 26, 2010

(30) Foreign Application Priority Data

Oct. 30, 2006 (FR) ..... 06 09529

(51) Int. Cl.
*H01H 11/00* (2006.01)
*H01H 65/00* (2006.01)

(52) U.S. Cl. ..... 29/622; 29/602.1; 29/858

(58) Field of Classification Search ..... 29/622, 29/602.1, 858, 860, 874, 876; 174/260–264; 335/151–154

See application file for complete search history.

(56) References Cited

U.S. PATENT DOCUMENTS

| | | | | |
|---|---|---|---|---|
| 3,548,139 | A | 12/1970 | Maynard et al. | |
| 4,268,953 | A * | 5/1981 | Tetro | 29/602.1 |
| 5,963,116 | A | 10/1999 | Endoh et al. | |
| 6,954,126 | B2 * | 10/2005 | Beigel et al. | 335/151 |
| 2003/0169138 | A1 | 9/2003 | Motta | |

FOREIGN PATENT DOCUMENTS

EP 0 805 471 A1 11/1997

OTHER PUBLICATIONS

International Search Report issued in PCT/EP2007/061176, mailed on Nov. 27, 2007, with translation, 4 pages.

* cited by examiner

*Primary Examiner* — Thiem Phan
(74) *Attorney, Agent, or Firm* — Osha · Liang LLP

(57) ABSTRACT

The invention relates to a method for production of a low current switch module, comprising the following steps: precutting a fine conductor path of several conducting circuits connected by connector tracks in the same sheet, positioning the contact relay and other optional electronic components on the precut conductor path, electrically and mechanically connecting said contact relay and the optional electronic components on the conductor track, encapsulating the unit comprising the conductor path, contact relay, the optional components, the pins and electrical connectors thereof and cutting certain connector tracks such as to separate said circuits.

9 Claims, 3 Drawing Sheets

METHOD FOR PRODUCING A LOW-CURRENT SWITCH MODULE COMPRISING ELECTRICAL COMPONENTS

The present invention relates to a method for manufacturing a low-current switch module and a device obtained by said method. It also relates to a special machine for implementing said method.

It applies in particular, but not exclusively, to switches equipping the general contact device for the electrical power supply of vehicles.

Conventionally, the general contact switch for motor vehicles was placed behind the general contact latch and opened or closed a circuit carrying a relatively high current (several tens of amps). This lead to the use of electrical wires of large diameter and large-volume connections. Furthermore, a significant drawback of this technology results from the fact that because of the high currents passing through it the contact is subject to the action of electrical arcs (when cutting off and opening) and therefore to premature wear. In order to eliminate these drawbacks and to reduce the cost and the mass of modern vehicles, the current tendency is instead to use low-current switches controlling a high-current switch located as close as possible to the use.

Low-current switches usually involve a stack of mechanical parts comprising a plate onto which electrically conductive tracks and a rotating contact driven by a rotor are overmolded. The rotor is additionally provided with contact pads intended to be applied to tracks. This assembly is housed in a case made of an electrically insulating material.

As an alternative, the tracks are produced on one of the two faces of a printed circuit, the other face of which is equipped with electronic components and connection pins. Nevertheless, the type of mounting has a weakness in connector technology, at each connector clip (vehicle harness) on the connection pins, the printed circuit works in bending, generating a risk of breaking said pad and/or the tracks it supports.

To solve this problem, it is possible to mold on only the pins and then to weld the pad of the printed circuit onto the pins. It is therefore a relatively complex and expensive solution.

In order to seal the assembly, an operation called "potting" is added. It involves burying the electrical components and the welds or solder joints in a resin. This operation takes a long time due to the cure time of the resin. It sometimes makes it necessary for products to pass through an oven and/or a vacuum chamber in order to remove bubbles. Of course, it cannot relate to the moveable contact parts of the switch. This is a particularly significant drawback. The object of the invention is first of all to eliminate this drawback so as to be able to protect the switch in the same way as the other components and welds or solder joints.

The solution to this problem therefore makes it necessary to use switches that can be controlled remotely without a mechanical connection so as to be able to be coated in a plastic without this being able to impair its operation.

To this end, the invention proposes a switch module comprising, on the one hand, a magnetically controlled switch, more commonly called "reed relay is", or reed switches comprising, in a sealed envelope, two flexible contact tabs sensitive to a magnetic field and, on the other hand, an integrated connection assembly and optionally other electronic components.

This type of switch is known to have a certain fragility both to mechanical stress (fractures) and to pressure, and even to temperature. The properties therefore seem incompatible with injection operations under pressure.

The invention succeeds in overcoming this difficulty using a method for producing a switch module of the aforementioned type comprising a thin conductive track, at least one reed switch, connecting members and a case enclosing the reed switch and constituting, with the connecting members, a connection element.

This method comprises the phases of:

- pre-cutting, in one and the same plate, a conductive track using several conductive circuits joined by connecting areas;
- positioning the reed switch and optional electronic components on the pre-cut conductive track;
- electrically and mechanically connecting said reed switch and the optional electronic components on the conductive track;
- encapsulating in an insulating material, by injection, the assembly composed by the conductive track, the reed switch, the optional components, their pins and the electrical connections; and
- breaking some connecting areas so as to separate the aforementioned circuits.

Thanks to these provisions, during encapsulation, the problems relating to the stresses exerted on the reed switch are solved due to the fact that the latter are borne by deformable elements (copper tracks) which by deforming absorb the stresses. This relates in particular to the differential glass/copper expansion, the forces exerted on the glass envelope and/or by the flow of material filling the mold.

This would not be the case if the tracks were rigidly fixed on a support such as a board of a printed circuit.

According to nonlimiting embodiments, the method according to the invention has the following additional features:

- the step of electrically and mechanically connecting electronic components to the conductive track may be a welding or soldering or crimping operation;
- the step of encapsulating the assembly composed of the conductive track, the components, their pins and the electrical connections in an insulating material may be an operation of injecting plastics under pressure;
- the plastics used for the injection may be plastics filled with fibers of high strength and/or high mechanical rigidity;
- the fibers of high strength and/or high mechanical rigidity are glass fibers or aramid fibers;
- the injection mold for the plastics may be arranged so that the material flux in the mold flows approximately along the components so that said components do not tend to move in the mold during filling at pressure, nor are internal stresses generated in the pins and/or welds;
- the method may comprise an additional step of separating several elements produced simultaneously on the same conductive track; and
- the step of separating several elements produced simultaneously on the same conductive track may be carried out by local drawing.

The invention also proposes a switch device produced according to the manufacture method set out above.

The invention also proposes a special machine making it possible to produce continuously and to from a continuous track according to the manufacturing method set out above.

An embodiment of the invention will be described below, by way of nonlimiting example, with reference to the appended drawings, in which:

FIG. 1 schematically shows a manufacture method according to the invention comprising an injection operation after welding;

Figure 4:
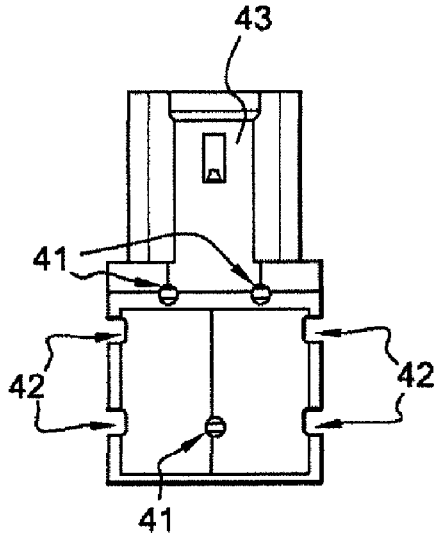
Figure 5:
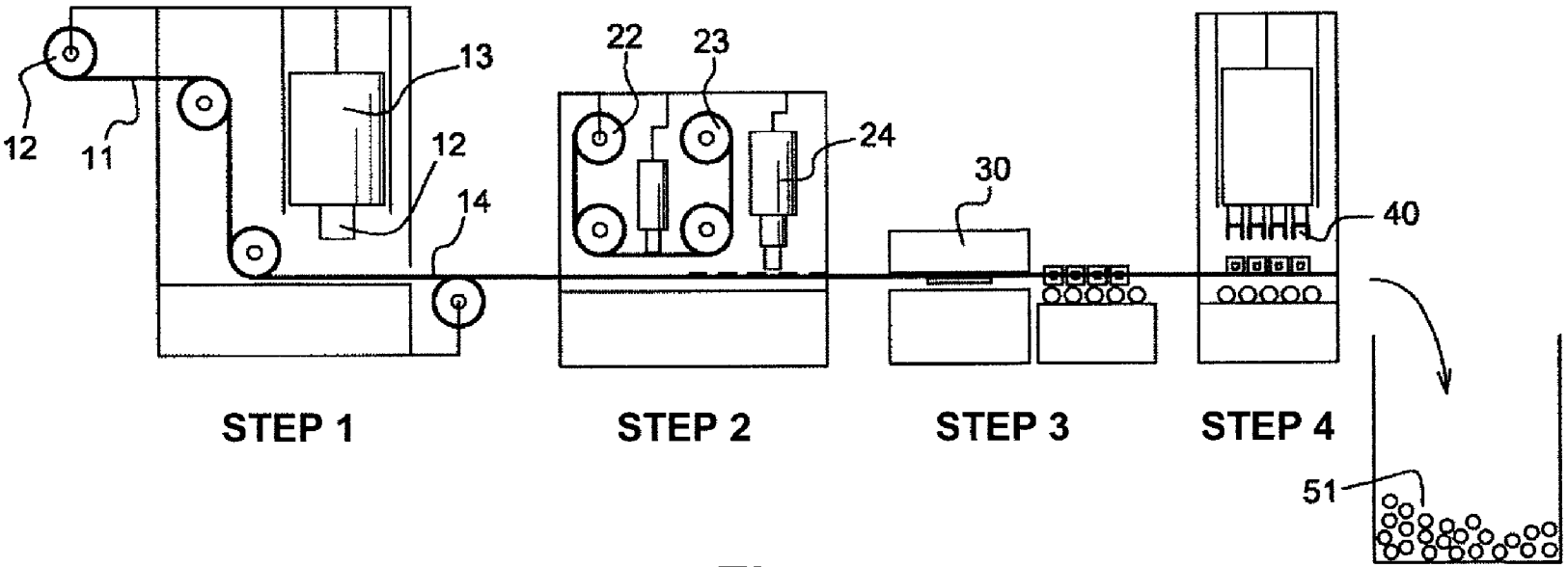

FIG. 4 schematically shows a switch obtained after separation of several switches obtained according to the method according to the invention; and FIG. 5 schematically shows a continuous manufacturing line for switch modules obtained according to the method according to the invention.

In the nonlimiting exemplary embodiment illustrated in FIGS. 2 to 5, the method principally comprises the following four steps:

1) Step 1: a thin continuous metal track with openings is cut. This metal track with openings is here a continuous strip of copper of low thickness of less than one millimeter. This metal strip 11 is wound onto a roller 12. This conductive strip 11 advances in jerks and passes under a cutting tool 12 which is moved by a punching machine 13. This continuous metal strip becomes a track with openings 14.

Figure 1:
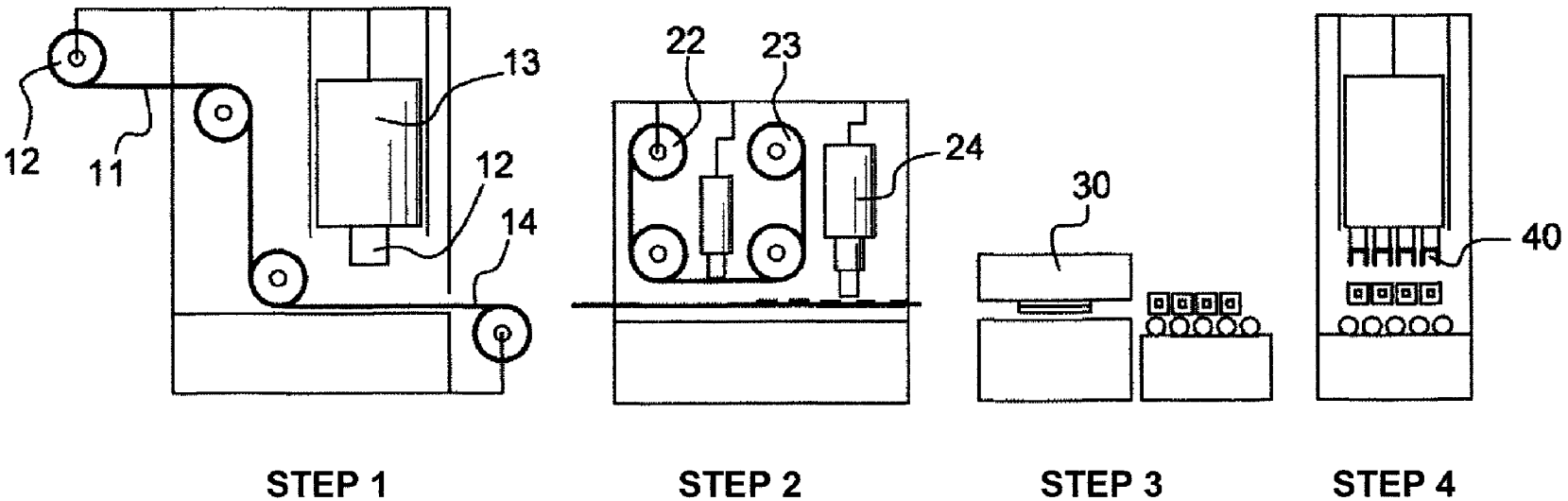
Figure 2:
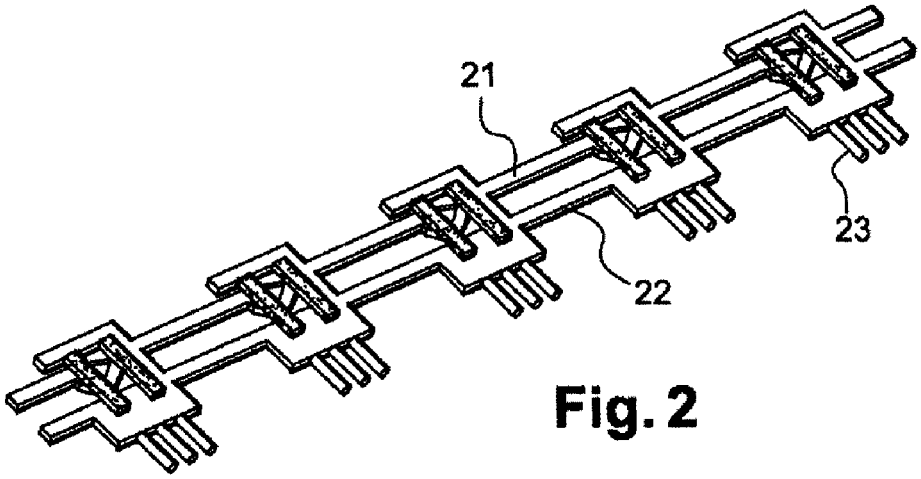
FIG. 2 shows an example of a metal track with openings enabling simultaneous production of several switch modules.

FIG. 2 shows part of an example of a conductive track according to the invention in greater detail. It can be seen that this track has, on the one hand, a lot of openings in order to have high flexibility and, on the other hand, comprises enough material to hold together mechanically. The two main conductors 21 and 22 can be seen, along with the pins 23 that form the conductive part of the integrated connection.

2) Step 2: the electronic components, some of which are fragile, such as the reed switches for example, are placed on and welded to the metal track with openings. This operation is carried out using the automatic welder or soldering machine 24. The components are put on a transfer belt and wound onto a reel 22. The empty transfer belt is wound onto the reel 23.

3) Step 3: the plastic filled with glass fiber is injected around the components and the metal track with openings so as mechanically and electrically to protect the components, their pins, the welds or solder joints, and both sides of the metal track with openings. The injection mold 30 comprises material inlets and vents positioned so that the hot molten plastic containing glass fibers, which is therefore relatively viscous, flows in a direction approximately parallel to the longitudinal direction of the components so that the components do not tend to move in the mold during the injection.

Figure 3:
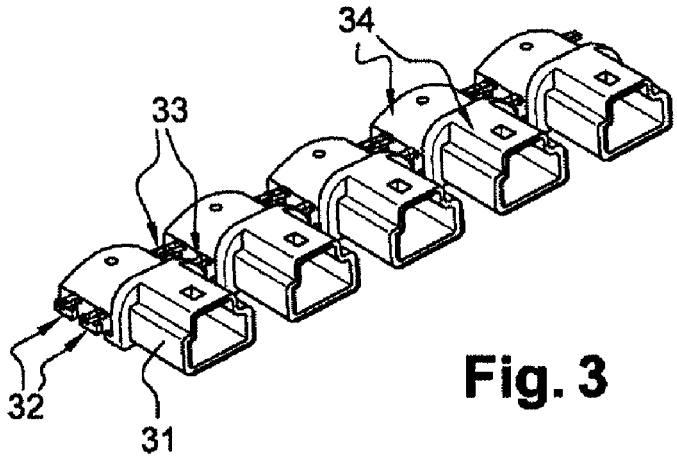
FIG. 3 shows an exemplary embodiment of several switch modules on the same metal track with openings before the separation operation.

FIG. 3 presents in greater detail an assembly of five switch modules according to the invention. It is possible to see the part reserved for the connection 31, and the areas 32 and 33 which will serve to separate the modules. It is also possible to notice the areas 34 that will be used for milling or drawing the mechanical connection elements of the conductive track.

4) Step 4: the switch modules are separated from one another by cutting or drawing and to place them through gravity in a basket 51 provided for this purpose. It should be noted that while separating the switch modules from each other the punch 40 at the same time cuts tracks that have been placed only to provide mechanical strength to the entire metal strip and which must be broken to ensure proper operation of the electrical circuit of each switch module. FIG. 4 shows a top view of a switch module 43 produced according to the invention. It is possible to notice, on the one hand, the locations 41 of three piercings provided for cutting the undesired tracks, and the locations 42 of the piercings provided for separating the switch modules from each other.

It can therefore be seen that it is possible to produce at low-cost contactless switch modules, comprising reed switches, the entire switch module being integrally protected, by the injection of plastics filled with glass fibers, against chemical, electrical and mechanical attack without a "potting" operation and continuously.

It can also be seen that this method can be used for designing a special automatic machine enabling continuous production of switch modules according to the invention without intermediate human intervention. For example, with a rate of 10 seconds per injection and a mold comprising 10 switch modules, it is therefore possible to produce one switch module per second (or around 80 000 switch modules per day) without human intervention, which is clearly of better performance than the current method involving the operation of "potting", which leads to being able to produce only a few hundred switch modules/day with a lot of human handling.

The person skilled in the art will be able to apply this concept to many other similar systems without departing from the scope of the invention defined in the attached claims.

The invention claimed is:

1. A method for producing a low-current switch module comprising a plurality of electrical components comprising:

a thin conductive track;

at least one reed switch comprising at least two conductive pins;

electrical connections allowing the component to be electrically and mechanically connected to the conductive track; and at least one insulating envelope electrically and mechanically protecting, simultaneously, the electronic component, the pins, the electrical connections, and both sides of the conductive track, and forming, with connection members, an integrated connection element;

wherein the method comprises:

pre-cutting, in one and the same plate, a thin conductive track using a plurality of conductive circuits joined by connecting areas;

positioning the reed switch and the plurality of electronic components on the pre-cut conductive track;

electrically and mechanically connecting said reed switch and the plurality of electronic components on the conductive track;

encapsulating in an insulating material, by injection, the assembly composed by the conductive track, the reed switch, and the plurality of electrical components, the pins, and the electrical connections; and breaking at least some connecting areas to separate the plurality of conductive circuits.

2. The method as claimed in claim 1, wherein electrically and mechanically connecting the plurality of electronic component to the conductive track is a welding or soldering operation.

3. The method as claimed in claim 1, wherein electrically and mechanically connecting the plurality of electronic components to the conductive track is a crimping operation.

4. The method as claimed in claim 1, wherein encapsulating the assembly composed of the conductive track, the plurality of electrical components, the pins, and the electrical connections in an insulating material comprises injecting plastics under pressure.

5. The method as claimed in claim 4, wherein plastics used for the injection operation are plastics filled with fibers of high strength and high mechanical rigidity.

6. The method as claimed in claim 5, wherein said fibers of high strength and high mechanical rigidity are one of glass fibers and aramid fibers.

7. The method as claimed in claim 4, wherein said plastic injection operation comprises a flow of material flux approximately along the components, and not transversely, so that said electrical components do not tend to move during filling at pressure, and internal stresses are not generated in the pins and welds.

8. The method as claimed in claim 1, further comprising separating several elements produced simultaneously on the same conductive track.

9. The method as claimed in claim 8, wherein separating several elements produced simultaneously on the same conductive track is carried out by local drawing.

* * * * *